US012509808B2

(12) United States Patent
Wayment

(10) Patent No.: US 12,509,808 B2
(45) Date of Patent: Dec. 30, 2025

(54) FRAME FABRIC CLIP

(71) Applicant: Gracewood Management, Inc., West Jordan, UT (US)

(72) Inventor: Cody Wayment, West Jordan, UT (US)

(73) Assignee: GRACEWOOD MANAGEMENT, INC., West Jordan, UT (US)

( * ) Notice: Subject to any disclaimer, the term of this patent is extended or adjusted under 35 U.S.C. 154(b) by 0 days.

(21) Appl. No.: 18/904,417

(22) Filed: Oct. 2, 2024

(65) Prior Publication Data

US 2025/0116045 A1 Apr. 10, 2025

Related U.S. Application Data

(60) Provisional application No. 63/588,504, filed on Oct. 6, 2023.

(51) Int. Cl.

| | |
|---|---|
| ***D05B 35/10*** | (2006.01) |
| ***D05B 11/00*** | (2006.01) |
| ***D05B 39/00*** | (2006.01) |

(52) U.S. Cl.
CPC ..... *D05B 35/105* (2013.01); *D05B 11/00* (2013.01); *D05B 39/005* (2013.01)

(58) Field of Classification Search
CPC ..... D05B 39/005; D05B 11/00; D05C 1/02
See application file for complete search history.

(56) References Cited

U.S. PATENT DOCUMENTS

| | | | | |
|---|---|---|---|---|
| 3,950,869 | A * | 4/1976 | Samarin | B44D 3/185 160/395 |
| 4,192,241 | A * | 3/1980 | Reed | D05B 11/00 112/117 |
| 4,479,654 | A | 10/1984 | Moscovich et al. | |
| 4,658,522 | A | 4/1987 | Kramer | |
| 5,586,400 | A | 12/1996 | Moore, III | |
| 6,209,240 | B1 | 4/2001 | Engle | |
| 6,393,797 | B1 | 5/2002 | Romes | |
| 6,615,756 | B2 | 9/2003 | Barrus | |
| 6,631,688 | B1 | 10/2003 | Maag | |
| 6,792,884 | B1 | 9/2004 | Barrus | |
| 6,932,008 | B2 | 8/2005 | Pfeifer | |
| 6,976,326 | B2 | 12/2005 | Tajima et al. | |
| 6,990,914 | B2 | 1/2006 | Canan | |
| 7,011,031 | B1 | 3/2006 | Bradley | |
| 7,377,222 | B1 | 5/2008 | Moore, III | |
| 8,281,726 | B2 | 10/2012 | Brunner et al. | |
| 9,145,630 | B2 | 9/2015 | McCoy et al. | |
| 9,476,151 | B2 | 10/2016 | Bagley | |

(Continued)

FOREIGN PATENT DOCUMENTS

GB 221761 A 9/1924

*Primary Examiner* — Danny Worrell
(74) *Attorney, Agent, or Firm* — Ryan L. Marshall; Jessica Kiser; Barnes & Thornburg LLP

(57) ABSTRACT

A quilting frame unit for supporting a quilt core to be sewn by a quilting machine includes a frame support structure, a frame assembly, and quilt core retention members. The frame support structure is adapted to support a machine carriage assembly that provides for lateral and longitudinal movement of the quilting machine. The frame assembly is affixed to the frame support structure. The quilt core retention members are configured to selectively couple with the frame assembly with the quilt core draped over to retain the quilt core to the frame assembly.

17 Claims, 8 Drawing Sheets

(56) References Cited

U.S. PATENT DOCUMENTS

| | | | | |
|---|---|---|---|---|
| 10,337,131 | B2 | 7/2019 | Konzak et al. | |
| 10,889,930 | B2 | 1/2021 | Bagley | |
| 10,920,352 | B2 | 2/2021 | Denning et al. | |
| 11,247,864 | B1 | 2/2022 | Martelli | |
| 11,668,035 | B2 * | 6/2023 | Bagley | D05B 39/005 112/119 |
| 11,987,919 | B2 * | 5/2024 | Bagley | D05B 75/06 |
| 2005/0229446 | A1 | 10/2005 | Bagley | |
| 2008/0196221 | A1 | 8/2008 | Merlin Madrigal | |
| 2017/0051445 | A1 | 2/2017 | Bagley | |
| 2017/0107652 | A1 | 4/2017 | McKinney | |
| 2021/0131000 | A1 | 5/2021 | Bagley | |
| 2022/0008857 | A1 | 1/2022 | Lapelosa | |
| 2022/0025564 | A1 | 1/2022 | Bagley et al. | |
| 2024/0068142 | A1 | 2/2024 | Abbe et al. | |

* cited by examiner

FRAME FABRIC CLIP

CROSS-REFERENCE TO RELATED APPLICATIONS

This application claims the benefit of U.S. Provisional Application No. 63/588,504, filed Oct. 6, 2023; the entire contents of this application is hereby incorporated by reference herein.

FIELD OF THE DISCLOSURE

The present disclosure relates generally to device and methods for machine quilting and more specifically to quilting frame and other devices for positioning and retention of fabric for sewing with a quilting machine.

BACKGROUND

Devices for machine quilting typically consist of three primary components, a frame, a sewing machine, and a machine carriage having a carriage bottom plate that travels laterally on an x-axis and a carriage top plate that travels longitudinally on a y-axis. Quilt fabric layers, which typically consist of backing fabric, batting, and top fabric, but may consist of as few as one layer of fabric or more than three layers, which single fabric layer, or multiple layers collectively.

For a typical quilting frame, the fabric layers are rolled onto fabric layer rails and fed from the respective fabric layer rails to a take-up rail that passes through the throat of the sewing machine, suspending the fabric layers of the quilt core together to rest on the sewing machine bed. For a typical quilting frame, in order for the fabric layers of the quilt core to remain flat and straight, it is necessary for the fabric layer rails and the take-up rail to be longer than the quilt is wide.

For a typical quilting frame, the sewing machine is positioned on and secured to the quilting frame carriage top plate and is guided on the machine carriage to create a desired stitching pattern as the layers of fabric are quilted together. The sewing machine, and particularly the needle bar of the sewing machine, are guided longitudinally and laterally across the available quilting work area that is determined by the length of the throat of the sewing machine and the width of the quilt fabric itself, the width of the quilt being limited to the width of the quilting frame. When the fabric in the work area has been sewn, the fabric is rolled forward from the fabric layer rails to the take-up rail so that the completed area is rolled onto the take-up rail which passes through the throat of the sewing machine. This also advances the fabric that has not yet been quilted into the work area, and the new strip of un-quilted fabric area may then be sewn. A typical quilting frame may need that the quilt be sewed from front to back, or vice versa, with the fabric progressively being fed onto the take-up rail as each strip of the quilt core is sewn from one side of the quilt core to the other.

An alternative to machine quilting with a traditional frame is to quilt by hand, performing all the stitching without a sewing machine, simply using a needle and thread. Another alternative is to baste the three layers of fabric together using pins or small stitches later to be removed. Once the fabric is basted, the user can quilt the layers together by guiding the fabric through the machine by hand. Hoops may also use to hold small areas of the quilt flat and straight to perform the stitching. Embroidery machines, for example, use a hoop to hold the fabric and then through motor control, move the hoop while the sewing machine stitches to create the desired patterns on the fabric.

Quilting without a frame may need basting and is time consuming. Hand quilting or quilting by using a hoop may also need basting, and moving the fabric to create the sewing patterns can be cumbersome due to the amount of fabric that has to be manipulated in a large quilt. Machine quilting on a frame is often a much more convenient and expeditious way to complete a quilt. The frame, however, may need to be large in order to make large quilts. Additionally, there may need to be a way to retain the quilt on the frame to save space, as many quilters do not have enough space to accommodate the large quilting frame.

SUMMARY

The present disclosure may comprise one or more of the following features and combinations thereof.

A quilting frame unit for supporting a quilt core to be sewn by a quilting machine may include a frame support structure adapted to support a machine carriage assembly, a frame assembly affixed to the frame support structure, and at least one quilt core retention member. The machine carriage assembly providing for lateral and longitudinal movement of the quilting machine.

In some embodiments, the frame assembly may include a plurality of fabric support members. The plurality of fabric support members may be configured to support the quilt core relative to the quilting machine.

In some embodiments, the quilt core retention member may include a retention clip and an elastic fabric retainer arm. The retention clip is configured to selectively couple to one support member of the plurality of fabric support members with the quilt core draped over the plurality of fabric support members to retain the quilt core to the one support member. The elastic fabric retainer arm has a fixed end coupled to the retention clip and a free end spaced apart from the fixed end.

In some embodiments, the elastic fabric retainer arm may be shaped to define a quilt-core roll receiving channel. The quilt-core receiving channel may be configured to receive a quilt core roll of unsewn or previously sewn fabric of the quilt core to support the quilt core roll relative to the frame assembly when the quilt core is draped over the frame assembly.

In some embodiments, the elastic fabric retainer arm may be biased toward a first loop shape. In the first loop shape, the quilt-core roll receiving channel has a first area so that the elastic fabric retainer arm applies a retaining force on the quilt core roll in the quilt-core roll receiving channel to block the quilt core roll from moving out of the quilt-core roll receiving channel.

In some embodiments, the elastic fabric retainer arm may be configured to deform from the first loop shape to a second loop shape. In the second lip shape, the quilt-core roll receiving channel has a second area that is greater than the first area to accommodate a larger quilt core roll. In some embodiments, the first loop shape and the second loop shape of the elastic fabric retainer arm may each have a circular cross-section.

In some embodiments, the free end of the elastic fabric retainer arm may engage the retention clip when the elastic fabric retainer arm has the first loop shape. The free end of the elastic fabric retainer arm may be spaced apart from the retention clip when the elastic fabric retainer arm has the second loop shape.

In some embodiments, the retention clip may include a clip base, a first deflectable clip arm, and a second deflectable clip arm. The first deflectable clip arm may extend from a first end of the clip base and the second deflectable clip arm may extend from a second end spaced apart from the first end of the clip base to define a support-member receiving channel. The support-member receiving channel may be configured to receive the one support member with the quilt core draped over the one support member. The fixed end of the elastic fabric retainer arm may be fixed to one of the first deflectable clip arm and the second deflectable clip arm.

In some embodiments, the first and second deflectable clip arms may include an engagement portion and a lip portion. The engagement portion may define a plurality of frame receiver facets each configured to engage with grooves on the one support member to couple the retention clip to the one support member. The lip portion may extend from the engagement portion away from the one support member to a terminal end. The lip portion of the first deflectable clip arm and the lip portion of the second deflectable clip arm may define a clip throat therebetween.

In some embodiments, each of the first and second deflectable clip arms may further include a tab. The tab may extend from the engagement portion away from the support-member receiving channel at a location spaced apart from the terminal end of the lip portion to define a fixed-end receiving channel therebetween. The fixed end of the elastic fabric retainer arm may be located in the fixed-end receiving channel to couple the elastic fabric retainer arm to the retention clip.

In some embodiments, the retention clip may include a clip base and a pair of deflectable clip arms. The pair of deflectable clip arms may extend from opposing ends of the clip base to define a support-member receiving channel configured to receive the one support member with the quilt core draped over the one support member. One clip arm of the pair of deflectable clip arms may be formed to define a fixed-end receiving channel and the fixed end of the elastic fabric retainer arm is located in the fixed-end receiving channel to couple the elastic fabric retainer arm to the retention clip.

According to another aspect of the present disclosure, a quilt core retention device adapted to retain a quilt core to be sewn by a quilting machine to a quilting frame may include a retention clip and a fabric retainer arm. The retention clip may be configured to selectively couple to one support member of the quilting frame with the quilt core draped over the quilting frame to retain the quilt core to the one support member. The fabric retainer arm may have a fixed end coupled to the retention clip and a free end spaced apart from the fixed end.

In some embodiments, the fabric retainer arm may be shaped to define a quilt-core roll receiving channel. The quilt-core roll receiving channel configured to receive a quilt core roll of unsewn or previously sewn fabric of the quilt core.

In some embodiments, the fabric retainer arm may be biased toward a first loop shape. In the first loop shape, the quilt-core roll receiving channel has a first area so that the fabric retainer arm applies a retaining force on the quilt core roll in the quilt-core roll receiving channel to block the quilt core roll from moving out of the quilt-core roll receiving channel.

In some embodiments, the fabric retainer arm may be configured to deform from the first loop shape to a second loop shape. In the second loop shape, the quilt-core roll receiving channel may have a second area that is greater than the first area to accommodate a larger quilt core roll.

In some embodiments, the free end of the fabric retainer arm may engage the retention clip when the fabric retainer arm has the first loop shape. The free end of the fabric retainer arm may be spaced apart from the retention clip when the fabric retainer arm has the second loop shape. In some embodiments, the fabric retainer arm may have a circular cross-sectional shape.

In some embodiments, the retention clip may include a clip base, a first deflectable clip arm that extends from a first end of the clip base, and a second deflectable clip arm that extends from a second end spaced apart from the first end of the clip base to define a support-member receiving channel. The support-member receiving channel may be configured to receive the one support member with the quilt core draped over the one support member. The fixed end of the fabric retainer arm may be fixed to one of the first deflectable clip arm and the second deflectable clip arm.

In some embodiments, each of the first and second deflectable clip arms may include an engagement portion and a lip portion. The engagement portion may define a plurality of frame receiver facets each configured to engage with grooves on the one support member to couple the retention clip to the one support member. The lip portion may extend from the engagement portion away from the one support member to a terminal end. The lip portion of the first deflectable clip arm and the lip portion of the second deflectable clip arm may define a clip throat therebetween.

In some embodiments, each of the first and second deflectable clip arms may further include a tab. The tab may extend from the engagement portion away from the support-member receiving channel at a location spaced apart from the terminal end of the lip portion to define a fixed-end receiving channel therebetween. The fixed end of the fabric retainer arm may be located in the fixed-end receiving channel to couple the fabric retainer arm to the retention clip.

In some embodiments, the retention clip may include a clip base and a pair of deflectable clip arms that extend from opposing ends of the clip base to define a support-member receiving channel. The support-member receiving channel may be configured to receive the one support member with the quilt core draped over the one support member.

In some embodiments, one clip arm of the pair of deflectable clip arms may be formed to define a fixed-end receiving channel. The fixed end of the fabric retainer arm may be located in the fixed-end receiving channel to couple the fabric retainer arm to the retention clip.

According to another aspect of the present disclosure, a method may include providing quilting frame unit. The quilting frame unit may include a frame support structure adapted to support a machine carriage assembly, a frame assembly affixed to the frame support structure that includes a plurality of fabric support members configured to support a quilt core relative to a quilting machine on the machine carriage assembly, and at least one quilt core retention member. The quilt core retention member may include a retention clip and a fabric retainer arm having a fixed end coupled to the retention clip and a free end spaced apart from the fixed end. The fabric retainer arm may be shaped to define a quilt-core roll receiving channel.

In some embodiments, the method may further include draping the quilt core over the plurality of fabric support members, coupling the retention clip of the at least one quilt core retention member to one support member of the plurality of fabric support members with the quilt core draped over the plurality of fabric support members, and deflecting the free end of the fabric retainer arm away from the retention clip to cause the free end of the fabric retainer arm to be spaced apart from the retention clip to define a gap therebetween.

In some embodiments, the method may further include inserting the a quilt core roll of unsewn or previously sewn fabric of the quilt core through the gap into the quilt-core roll receiving channel formed by the fabric retainer arm so that the quilt core roll is supported relative to the frame assembly when the quilt core roll is draped over the frame assembly and releasing the free end of the fabric retainer arm to cause the fabric retainer arm to retain to an original shape so that the fabric retainer arm applies a retaining force on the quilt core roll in the quilt-core roll receiving channel to block the quilt core roll from moving out of the quilt-core roll receiving channel.

In some embodiments, the retention clip may include a clip base, a first deflectable clip arm that extends from a first end of the clip base, and a second deflectable clip arm that extends from a second end spaced apart from the first end of the clip base to define a support-member receiving channel. The support-member receiving channel may be configured to receive the one support member with the quilt core draped over the one support member. The fixed end of the fabric retainer arm may be fixed to one of the first deflectable clip arm and the second deflectable clip arm.

In some embodiments, each of the first and second deflectable clip arms may include an engagement portion and a lip portion. The engagement portion may define a plurality of frame receiver facets each configured to engage with grooves on the one support member to couple the retention clip to the one support member. The lip portion may extend from the engagement portion away from the one support member to a terminal end. The lip portion of the first deflectable clip arm and the lip portion of the second deflectable clip arm may define a clip throat therebetween.

In some embodiments, each of the first and second deflectable clip arms may further include a tab. The tab may extend from the engagement portion away from the support-member receiving channel at a location spaced apart from the terminal end of the lip portion to define a fixed-end receiving channel therebetween. The fixed end of the fabric retainer arm may be located in the fixed-end receiving channel to couple the fabric retainer arm to the retention clip.

These and other features of the present disclosure will become more apparent from the following description of the illustrative embodiments.

DETAILED DESCRIPTION OF THE DRAWINGS

Figure 1:
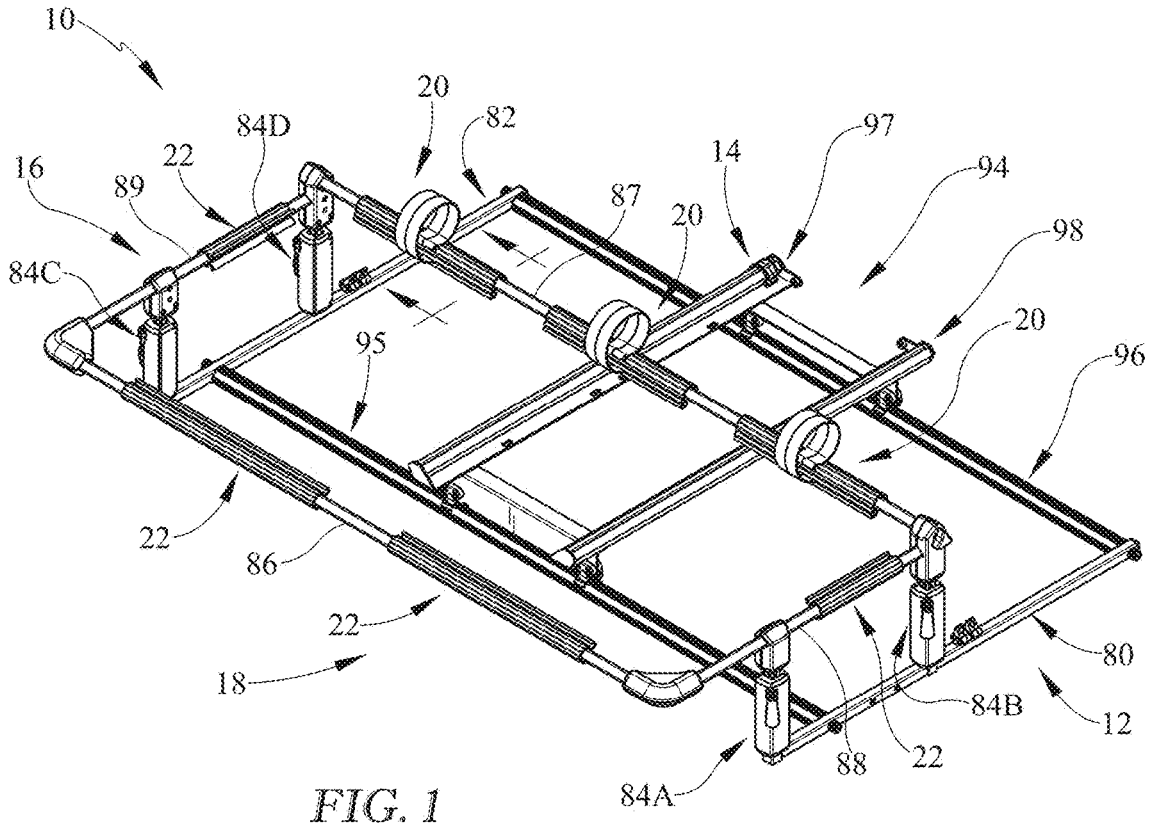
FIG. 1 is a front perspective view of a quilting frame unit showing the sewing frame unit includes a frame support structure adapted to support a machine carriage assembly on a workable surface, a frame assembly affixed to the frame support structure to support a quilt core to be sewn by a quilting machine, and a retention system including quilt core retention members configured be selectively coupled to a rear fabric support member of the frame assembly.

For the purposes of promoting an understanding of the principles of the disclosure, reference will now be made to a number of illustrative embodiments illustrated in the drawings and specific language will be used to describe the same.

Figure 2:
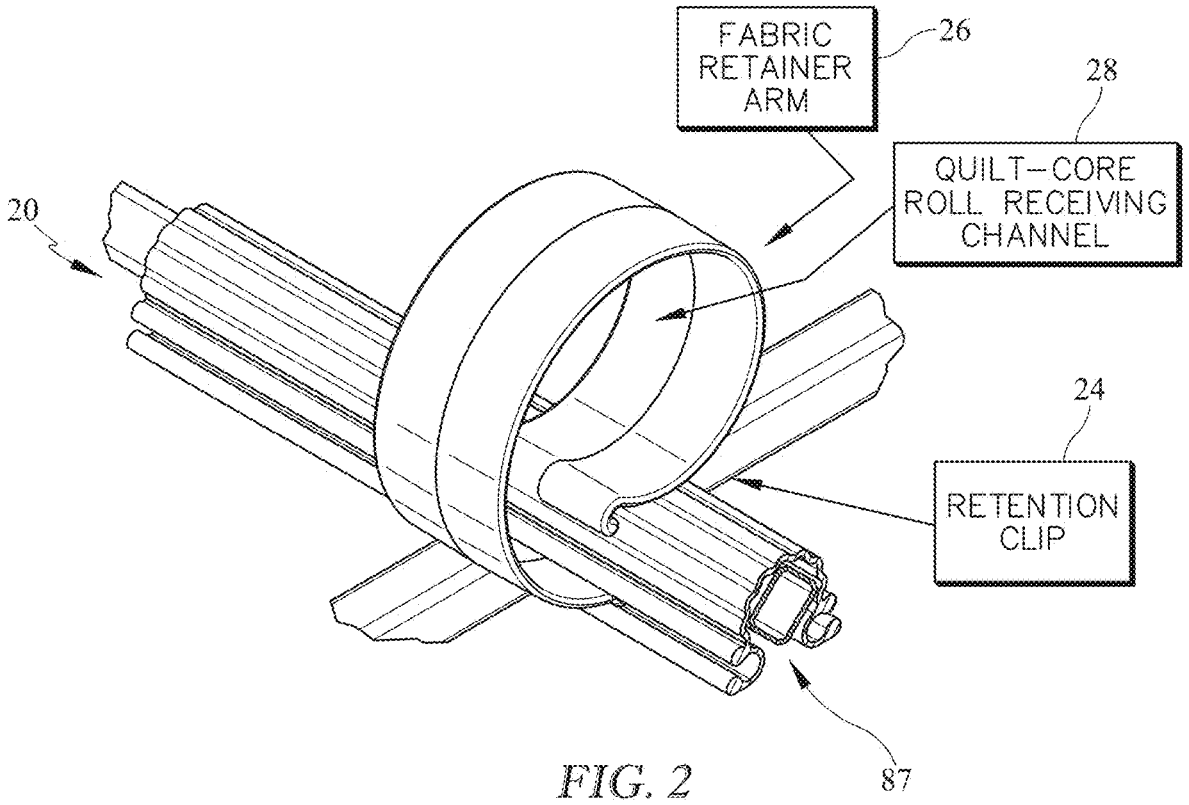
FIG. 2 is a detail view of FIG. 1 showing each quilt core retention member include includes a u-shaped retention clip configured to selectively engage the rear fabric support member of the frame assembly to couple the retention member to the frame assembly and an elastic fabric retainer arm that defines a quilt-core roll receiving channel configured to receive a quilt core roll of unsewn or previously sewn fabric of the quilt core as shown in FIGS. 9 and 10 to support the quilt core roll relative to the frame assembly when the quilt core is draped over the frame assembly.

A quilting frame unit 10 for supporting a quilt core 100 to be sewn by a quilting machine 110 is shown in FIGS. 1 and 2. The quilting frame unit 10 includes a frame support structure 12, a machine carriage assembly 14, a frame assembly 16 including a plurality of fabric support members 86, 87, 88, 89 configured to support the quilt core 100 relative to the quilting machine 110, and a retention system 18. The frame support structure 12 is adapted to support the machine carriage assembly 14. The machine carriage assembly 14 provides for lateral and longitudinal movement of the quilting machine 110 as suggested by arrows A and B in FIG. 3. The frame assembly 16 is affixed to the frame support structure 12. The retention system 18 is configured to retain the quilt core 100 to the plurality of fabric support members 86, 87, 88, 89 of the frame assembly 16 so that the quilt core 100 is held in place on the frame assembly 16 while the quilt core 100 is being sewn.

To sew the quilt core, the quilt core 100 is draped over the fabric support members 86, 87, 88, 89 of the frame assembly 16. The retention system 18 is then used to retain the quilt core 100 to the plurality of fabric support members 86, 87, 88, 89 of the frame assembly 16. This positions a fabric zone 120 of the quilt core 100 for sewing by the quilting machine 110. Successive fabric zones 130 of the quilt core 100 may be consecutively secured to the frame assembly 16 of the quilting frame unit 10 with the sewn fabric zones of the quilt core 100 advanced into the machine throat 112 of the quilting machine 110 and rolled onto a flexible take-up spool 114. This helps keep the fabric layers of the sewn fabric zones from interfering with the sewing of the successive fabric zone 130 positioned on the frame assembly 16 for sewing.

The retention system 18 includes one or more quilt core retention members 20 and one or more secondary retention clips 22 as shown in FIGS. 1 and 2. The quilt core retention devices 20 and the secondary retention clips 22 are configured to selectively couple with one of the fabric support members 86, 87, 88, 89 with the quilt core draped over to retain the quilt core 100 to the frame assembly 16.

Each of the quilt core retention devices 20 includes a retention clip 24 and an elastic fabric retainer arm 26 as shown in FIGS. 2-12. The retention clip 24 selectively couples to the rear fabric support member 87 of the frame assembly 16 with the quilt core draped over the plurality of fabric support members 86, 87, 88, 89 to retain the quilt core 100 to the rear fabric support member 87. The elastic fabric retainer arm 26 defines a quilt-core roll receiving channel 28 configured to receive a quilt core roll 100R of unsewn or previously sewn fabric of the quilt core 100.

The quilt-core roll receiving channel 28 is configured to receive a quilt core roll 100R of unsewn or previously sewn fabric of the quilt core 100 to support the quilt core roll 100R relative to the frame assembly 16 when the quilt core 100 is draped over the frame assembly 16.

In this way, the fabric layers of the sewn/unsewn fabric zones are prevented from interfering with the sewing of the fabric zone 130 positioned on the frame assembly 16 for sewing. Additionally, by securing the quilt core roll 100R to the rear fabric support member 87, successive or subsequent fabric zones 130 may be positioned and secured for sewing without much effort of repositioning the quilt core 100.

The elastic fabric retainer arm 26 has a fixed end 30 coupled to the retention clip 24 and a free end 32 spaced apart from the fixed end 30 as shown in FIGS. 4-12. The elastic fabric retainer arm 26 is configured to be deformed or deflected to adjust the size of the quilt-core roll receiving channel 28 to be able to receive the quilt core roll 100R. The fabric retainer arm 26 is made of an elastic material configured to return to its normal shape, or a first loop shape, after the fabric retainer arm 26 has been deflected or deformed.

The elastic material may be a plastic material in some embodiments. The plastic material may be polycarbonate in some embodiments. In some embodiments, the elastic material is another suitable material that returns to its original shape after being deformed.

Figure 9:
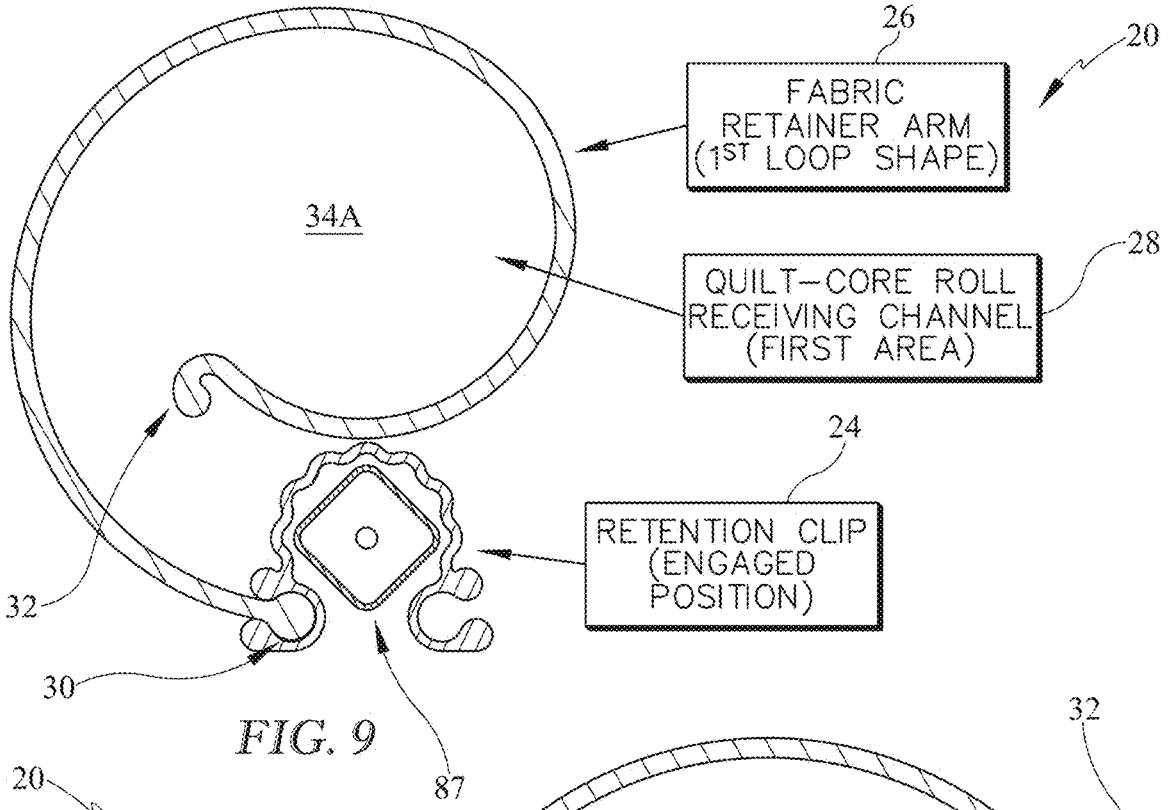
FIG. 9 is a cross-sectional view similar to FIG. 8 showing the retention clip of the retention member has been moved from the partially engaged position as shown in FIG. 8 to a fully engaged position to cause the rear fabric support member to be located in the support-member receiving channel so that frame receiver facets on the clip arms engage with the grooves on the fabric support member to couple the retention clip to the support member, and further showing the elastic fabric retainer in a first loop shape or an original loop shape in which the quilt-core roll receiving channel has a first area.

The elastic fabric retainer arm 26 is biased toward a first loop shape or original loop shape so that the elastic fabric retainer arm 26 applies a retaining force FR on the quilt core roll 100R in the quilt-core roll receiving channel 28 to block the quilt core roll 100R from moving out of the quilt-core roll receiving channel 28. In the first loop shape, the quilt-core roll receiving channel 28 has a first area 34A as shown in FIG. 9.

Figure 10:
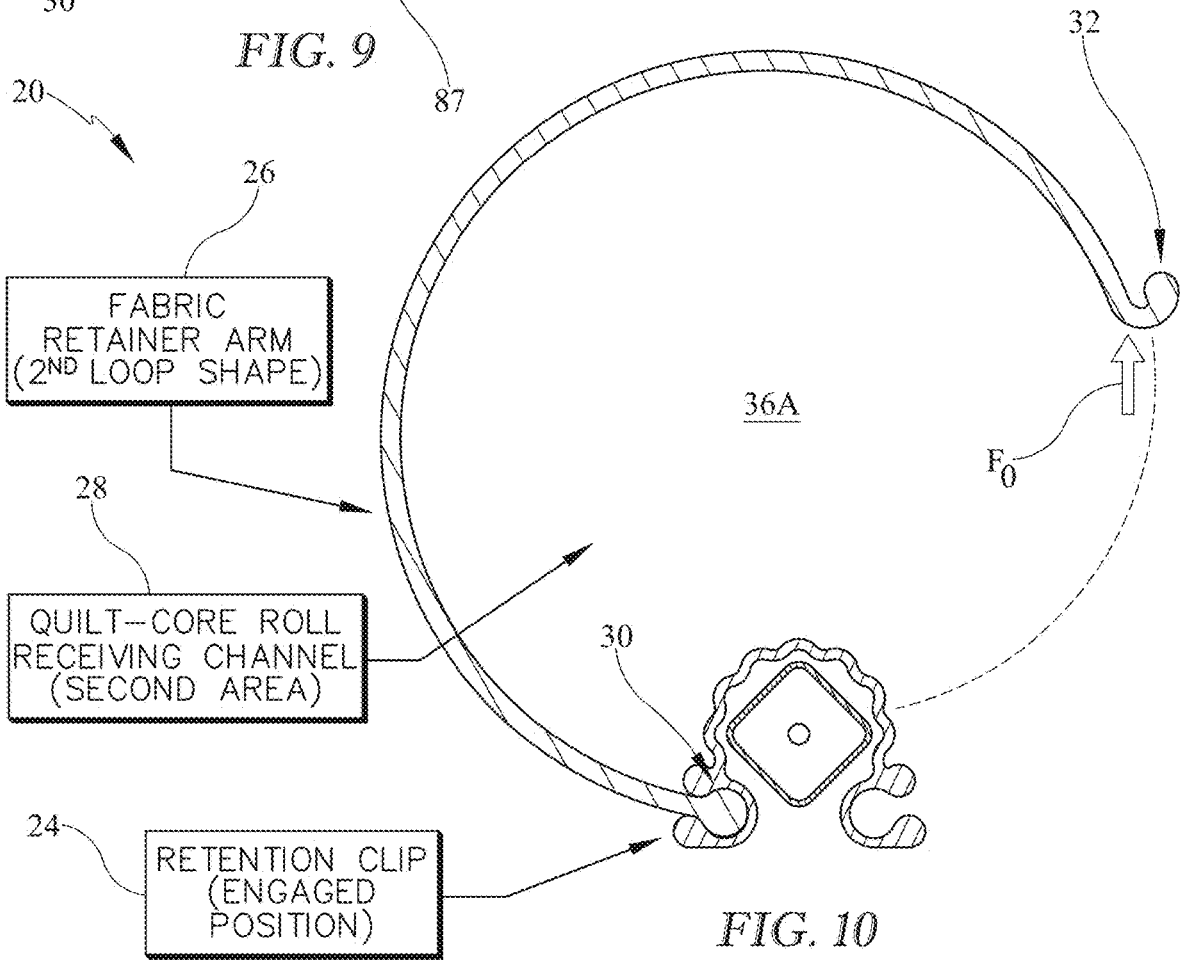
FIG. 10 is a cross-sectional view similar to FIG. 9 showing the elastic fabric retainer has been deflected to a second loop shape in which the quilt-core roll receiving channel has a second area that is greater than the first area to accommodate the quilt core roll.

When the elastic fabric retainer arm 26 is deflected, the elastic fabric retainer arm 26 deforms from the first loop shape to a second loop shape as shown in FIG. 10. In the second loop shape, the quilt-core roll receiving channel 28 has a second area 36A that is greater than the first area 34A to accommodate the quilt core roll 100R. As shown in FIG. 10, there is not an opening between the fabric retainer arm 26 and the retention clip 24 so that the quilt core roll 100R may be inserted into the quilt-core roll receiving channel 28.

To deflect the fabric retainer arm 26, a user may need to apply an opening force to the elastic fabric retainer arm 26 as suggested in FIG. 10. The opening force needs to be greater than the retaining force FR to cause the elastic fabric retainer arm 26 to deflect. Once the quilt core roll 100R is in the quilt-core roll receiving channel 28, the user may release the opening force, which cases the elastic fabric retainer arm 26 to deflect back towards the first loop shape and apply the retaining force FR to the quilt core roll 100R.

Figure 11:
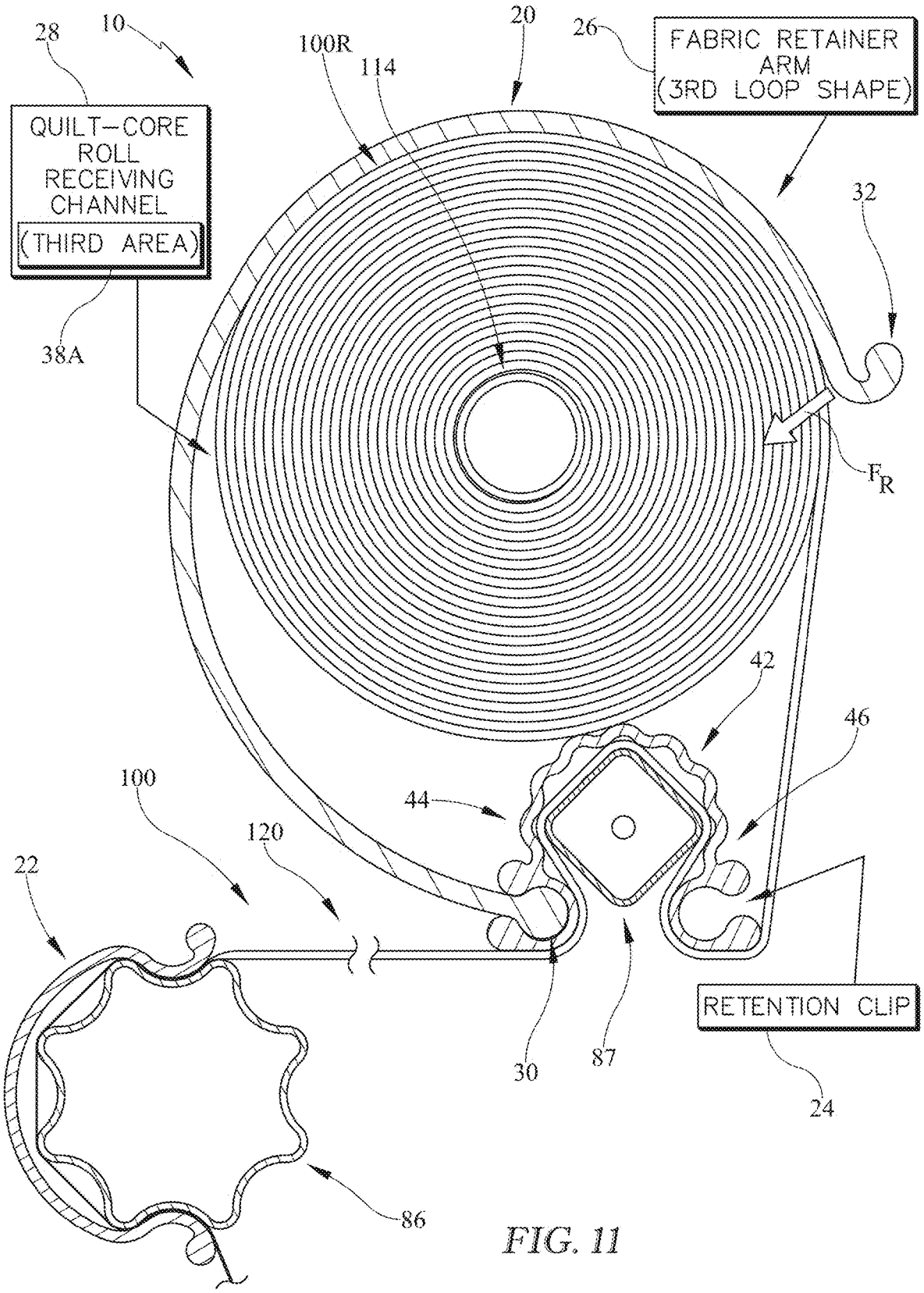
FIG. 11 is a cross-sectional view of the quilt frame unit of FIG. 2 showing the quilt core retention device coupled to the rear fabric support member and one of the retention clips coupled to the front fabric support member with the quilt core draped over the front and rear fabric support members to secure and position a fabric zone of the quilt core on the frame assembly for sewing by the quilting machine, and further showing the quilt core roll located in the quilt-core roll receiving channel of the quilt core retention member with the retention clamp applying a retaining force to the quilt core roll to block the quilt core roll from moving out of the quilt-core roll receiving channel.

While the quilt core roll 100R is in the quilt-core roll receiving channel 28, the elastic fabric retainer arm 26 may have a third loop shape as shown in FIG. 11. In the third loop shape, the quilt-core roll receiving channel 28 has a third area 38A that is greater than the first area 34A but less than the second area 36A. In the illustrative embodiment, the elastic fabric retainer arm 26 may have a plurality of loops shapes with varying areas between the first and second areas 34A, 36A depending on the size of the quilt core roll 100R to be received in the quilt-core roll receiving channel 28.

Turning again to the retention clip 24, the retention clip 24 includes a clip base 42, a first deflectable clip arm 44, and a second deflectable clip arm 46 as shown in FIG. 4-12. The first deflectable clip arm 44 extends from a first end of the clip base 42. The second deflectable clip arm 46 extends from a second end spaced apart from the first end of the clip base 42 to define a support-member receiving channel 48. The support-member receiving channel 48 is configured to receive the rear fabric support member 87.

The fixed end 30 of the elastic fabric retainer arm 26 is fixed to one of the first deflectable clip arm 44 and the second deflectable clip arm 46 as shown in FIGS. 4-12. In the illustrative embodiment, the fixed end 30 is fixed to the first deflectable clip arm 44. The fixed end 30 may be interchangeable coupled to either one of the first deflectable clip arm 44 and the second deflectable clip arm 46.

Figure 5:
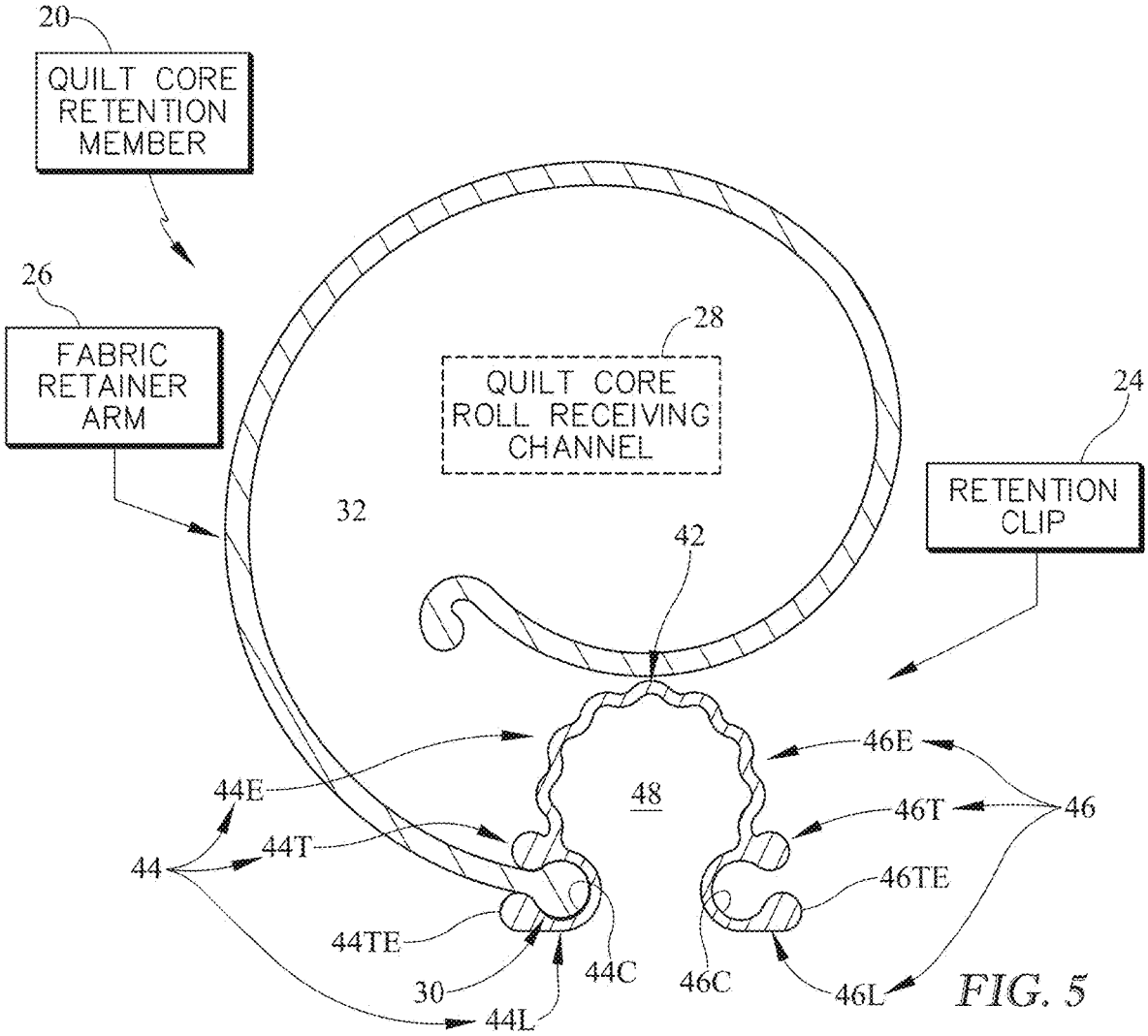
FIG. 5 is a cross-section view of the quilt core retention member of FIG. 2 showing each deflectable clip arm includes a clip base and a pair of deflectable clip arms that extend from opposite ends of the clip base to define a support-member receiving channel configured to receive the rear fabric support member.
Figure 6:
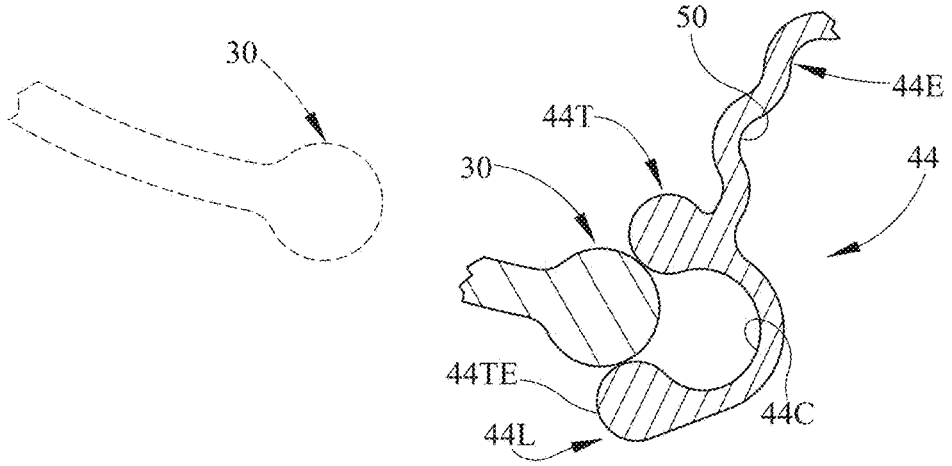
FIG. 6 is an exploded view of a portion of the quilt core retention member of FIG. 2 showing each deflectable clip arm includes an engagement portion defining a plurality of frame receiver facets that engage with grooves on the rear fabric support member to couple the retention clip to the rear fabric support member, a lip portion that extends from the engagement portion away from the rear fabric support member to a terminal end, and a tab that extends from the engagement portion away from the support-member receiving channel at a location spaced apart from the terminal end of the lip portion to define a fixed-end receiving channel therebetween, and further showing the tab and terminal end of the lip portion deflect when the fixed end of the elastic fabric retainer arm is inserted into the fixed-end receiving channel to couple the elastic fabric retainer arm to the retention clip.

Each deflectable clip arm 44, 46 includes an engagement portion 44E, 46E, a lip portion 44L, 46L, and a tab 44T, 46T as shown in FIGS. 5 and 6. The engagement portion 44E, 46E defines a plurality of frame receiver facets 50. The frame receiver facets 50 are configured to engage with grooves 92 on the support member 87 to couple the retention clip 24 to the support member 87. The lip portion 44L, 46L extends from the engagement portion 44E, 46E away from the support member 87 to a terminal end 44TE, 46TE. The lip portion 44L of the first deflectable clip arm 44 and the lip portion 46L of the second deflectable clip arm 46 define a clip throat 52 therebetween.

The tab 44T, 46T extends from the engagement portion 44E, 46E away from the support-member receiving channel 48 at a location spaced apart from the terminal end 44TE, 46TE of the lip portion 44L, 46L to define a fixed-end receiving channel 44C, 46C therebetween. The fixed end 30 of the elastic fabric retainer arm 26 is located in the fixed-end receiving channel 44C to couple the elastic fabric retainer arm 26 to the retention clip 24 as shown in FIGS. 5 and 6.

Figure 4:
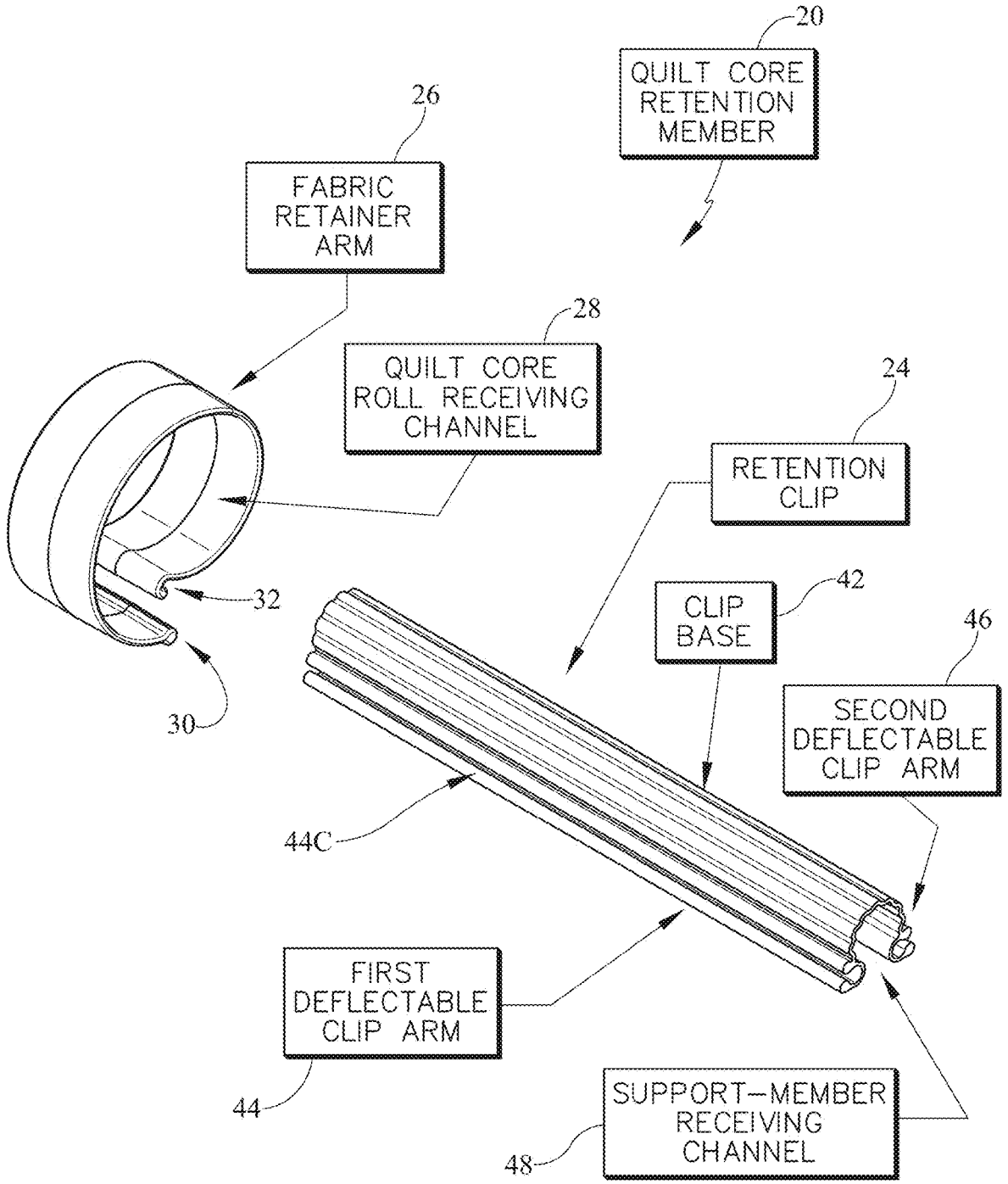
FIG. 4 is an exploded view of one of the quilt core retention member included in the retention system of the quilting frame of FIG. 1 showing the quilt core retention member includes the retention clip and the elastic fabric retainer arm, the retention clip includes a clip base and a pair of deflectable clip arms that extend from opposing ends of the clip base to define a support-member receiving channel that receives the rear fabric support members, and the elastic fabric retainer arm having a fixed end configured to couple to the retention clip and a free end spaced apart from the fixed end to define a quilt-core roll receiving channel.

In the illustrative embodiment, the retention clip 24 has a generally u-shaped or horseshoe shaped cross-section as shown in FIGS. 4-12. The term "u-shaped" when used in reference to the retention clip 24 in this specification, including the claims, shall be defined to include any retention clip shape having a u-shaped, generally u-shaped, or horseshoe shaped cross-section, and to include a retention clip shape having a cross-section in which the retention clip cross-section has a retention clip receiving width 24W which is greater than the retention clip throat width 52W of the retention clip throat 52 as shown in FIGS. 4 and 5.

Each of the first and second deflectable clip arms 44, 46 of the retention clip 24 are elastic such that when the clip arms 44, 46 deflect, they reciprocate back to the original shape. Therefore, the retention clip 24 retains its u-shaped or horseshoe shaped cross-section after attaching or removing the retention clip from the rear fabric support member 87.

Figure 7:
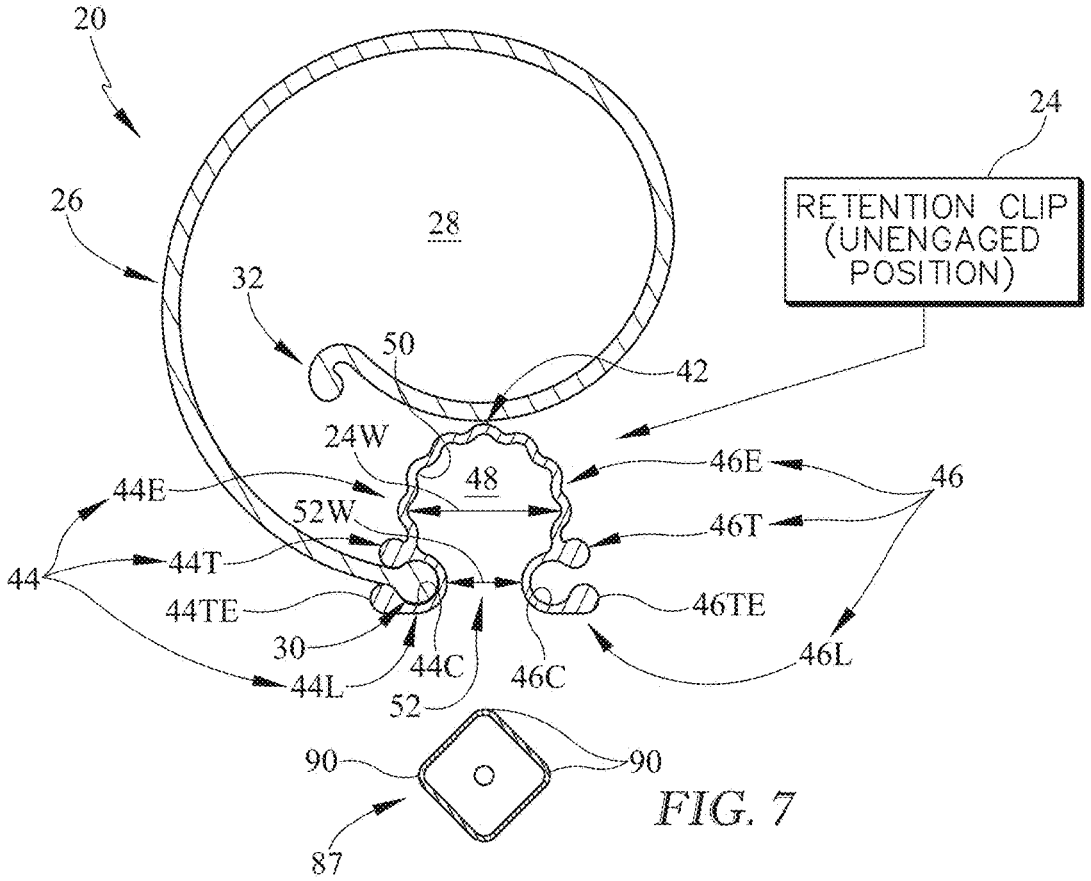
FIG. 7 is a cross-sectional view of the quilt core retention member of FIG. 2 showing the retention clip is in an unengaged position in which the retention clip is spaced apart from the rear fabric support member so that the rear fabric support member is not located in the support-member receiving channel.

The original shape of the retention clip 24 is shown in FIG. 7, where the retention clip 24 is in an unengaged position. As the retention clip 24 is attached to the fabric support member 87, the retention clip 24 moves from the unengaged position to a partially engaged position as shown in FIG. 8, which causes the pair of deflectable clip arms 44, 46 to deflect relative the clip base 42.

Figure 8:
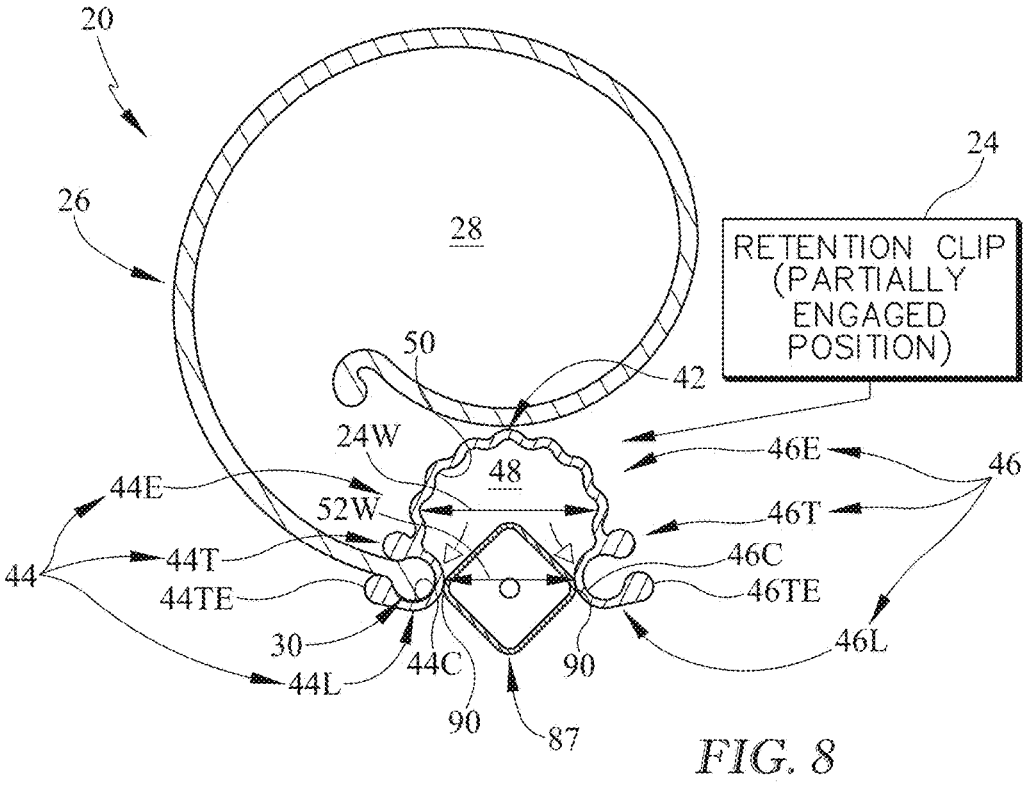
FIG. 8 is a cross-sectional view similar to FIG. 7 showing the retention clip has been moved from the unengaged position as shown in FIG. 7 to a partially engaged position to cause the pair of deflectable clip arms to deflect relative the clip base to allow the rear fabric support member to move into the support-member receiving channel of the retention clip to couple the quilt core retention device to the rear fabric support member of the frame assembly.

In the partially engaged position, the pair of deflectable clip arms 44, 46 are deflected relative the clip base 42 such that the retention clip throat width 52W of the clip throat 52 has increased as shown in FIG. 8. This allows the rear fabric support member 87 to move into the support-member receiving channel 48 of the retention clip 24 so that the retention clip 24 is in a fully engaged position as shown in FIG. 9. In the fully engaged position, the rear fabric support member 87 is located in the support-member receiving channel 48 so that frame receiver facets 50 on the clip arms 44, 46 engage with the grooves 92 on the fabric support member 87.

The fixed end 30 of the elastic fabric retainer arm 26 has the same cross-section as the fixed-end receiving channel 44C formed in the deflectable clip arm 44 as shown in FIGS. 5 and 6. In the illustrative embodiment, the fixed end 30 of the elastic fabric retainer arm 26 is thicker than an opening of the channel 44C so that the fixed end 30 of the elastic fabric retainer arm 26 does not move out of the channel 44C.

The fixed end 30 of the elastic fabric retainer arm 26 may be inserted into the channel 44C such that the tab 44T and the lip portion 44L deflect as shown in FIG. 6. In this way, the fixed end 30 of the elastic fabric retainer arm 26 may pass through into the channel 44C. The tab 44T and the lip portion 44L are elastic such that when the tab 44T and the lip portion 44L deflect, they reciprocate back to the original shape to hold the fixed end 30 in place.

Alternatively, the fixed end 30 may be slide into the channel 44C from either side of the retention clip 24 as shown in FIG. 24. Rather than deflect the tab 44T and the lip portion 44L, the fixed end 30 may be slide into the channel 44C through open ends of the channel 44C on either side of the retention clip 24 as shown in FIG. 2.

The free end 32 of the elastic fabric retainer arm 26 has a terminal end with a hook shape as shown in FIGS. 5-12. The hook shape of the free end may make it easier for the user to engage the free end 32 of the elastic fabric retainer arm 26 and deflect the elastic fabric retainer arm 26 to its different shapes.

Figure 3:
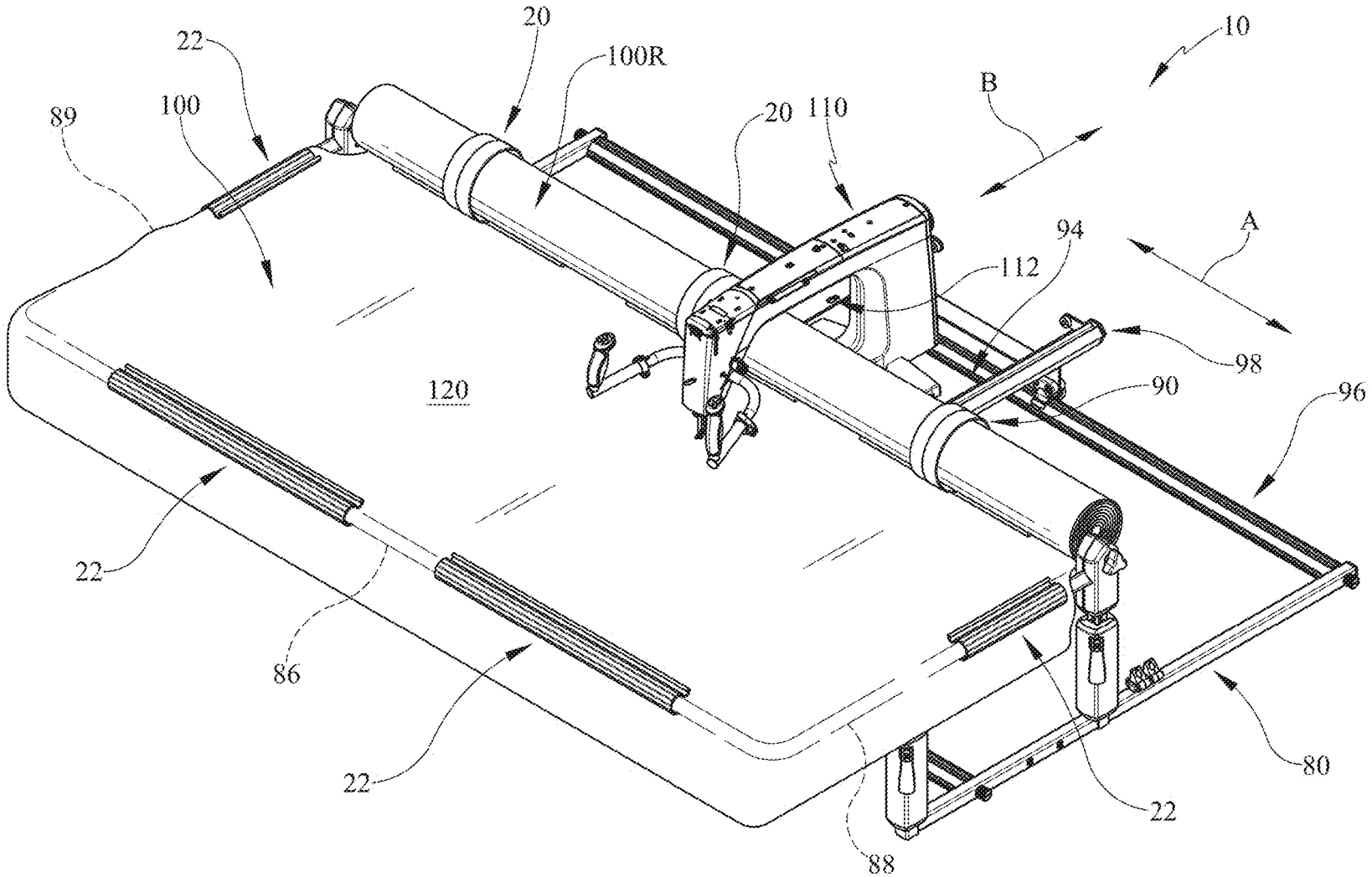
FIG. 3 is a front perspective view of the quilting frame unit of FIG. 1 showing the quilt core positioned on the frame assembly and secured to the frame assembly by the retention system so that a fabric zone of the quilt core is on the frame assembly for sewing by the quilting machine.

Turning again to the frame support structure 12, the frame support structure 12 includes a first end support 80, a second end support 82, and frame support members 84A, 84B, 84C, 84D as shown in FIGS. 1 and 3. Front carriage track 95 and rear carriage track 96 included in the machine carriage assembly 14 each extend laterally between and interconnect the first and second end supports 80, 82. The frame support members 84A, 84B connects the frame assembly 16 to the first end support 80, while the frame support members 84C, 84D connects the frame assembly 16 to the second end support 82.

The frame assembly 16 includes the plurality of fabric support members 86, 87, 88, 89 as shown in FIGS. 1 and 3. The plurality of fabric support members 86, 87, 88, 89 are configured to support the quilt core 100 relative to the quilting machine 110.

The plurality of fabric support members 86, 87, 88, 89 includes a front fabric support member 86, a rear fabric support member 87, a first end fabric support member 88, and a second end fabric support member 89 as shown in FIGS. 1 and 3. The first end fabric support member 88 is coupled to the first end support 80 of the frame support structure 12. The second end fabric support member 89 is spaced apart laterally from the first end fabric support member 88. The second end fabric support member 89 is coupled to the second end support 82 of the frame support structure 12.

The front fabric support member 86 extends laterally between and interconnects the first end fabric support member 88 and the second end fabric support member 89. The rear fabric support member 87 is spaced apart longitudinally from the front fabric support member 86. The rear fabric support member 87 extends laterally between the first end support 80 and the second end support 82 of the frame support structure 12 through the machine throat 112 of the quilting machine 110.

In the illustrative embodiment, the rear fabric support member 87 has a rectangular cross-sectional shape as shown in FIGS. 4-12. The rear fabric support member 87 is shaped to include ridges 90 as shown in FIGS. 4-12. The frame receiver facets 50 engage with the ridges 90 on the rear fabric support member 87 to couple the retention clip 24 to the fabric support member 87.

Figure 12:
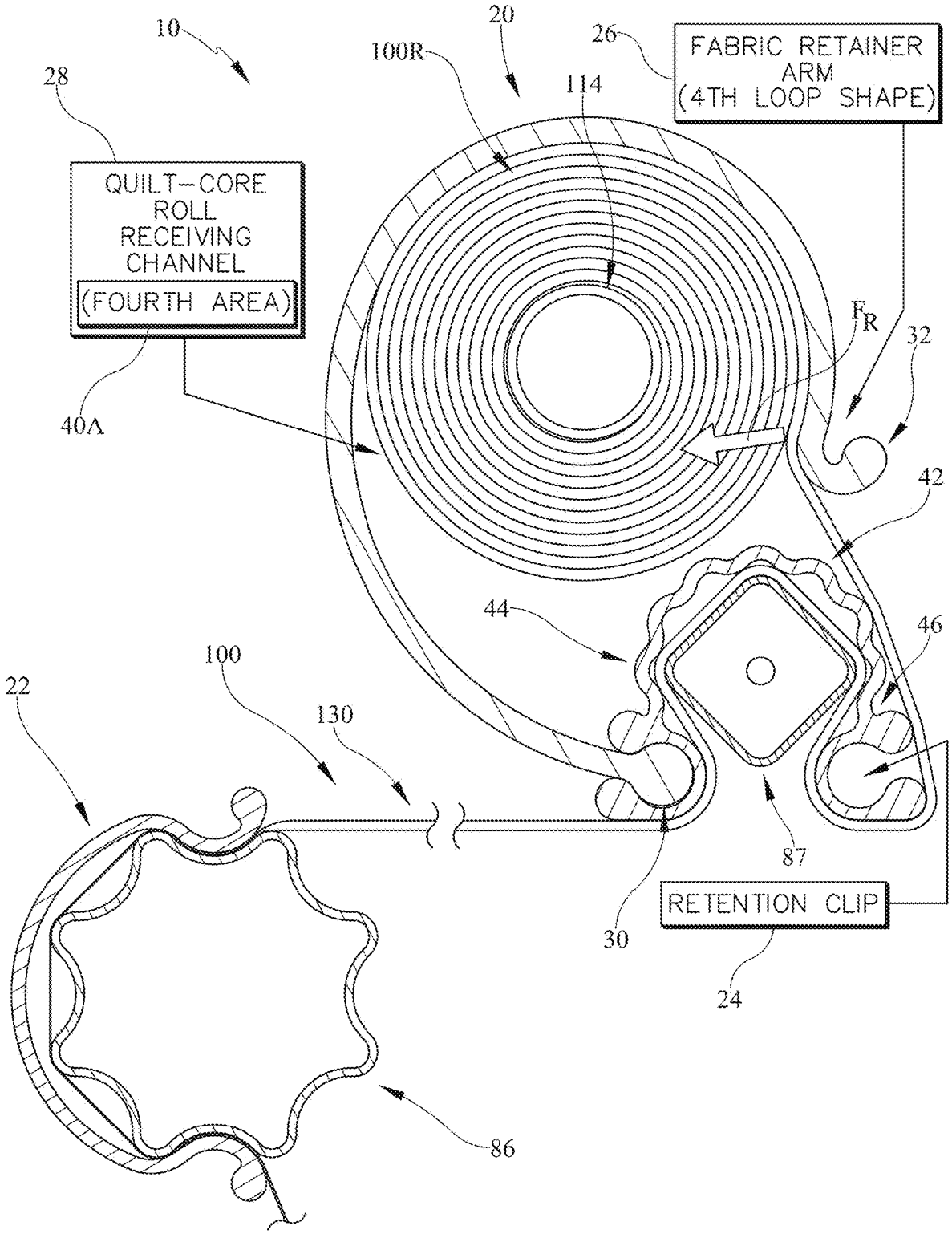
FIG. 12 is a cross-sectional view similar to FIG. 11 showing a portion of the fabric in the quilt core roll has been unrolled from the take up spool and repositioned so that a new fabric zone is secured on the frame assembly for sewing by the quilting machine.

The other fabric support members 86, 88, 89 have a different cross-sectional shape as shown in FIGS. 11 and 12. The other fabric support members 86, 88, 89 are shaped to include ridges 90 and grooves 92 as shown in FIGS. 11 and 12. The frame receiver facets 62 engage with the grooves 92 on the corresponding fabric support member 86, 88, 89 to couple the corresponding retention clip 22 to the fabric support member 86, 88, 89.

In the illustrative embodiment, the rear fabric support member 87 has a square cross-sectional shape. In some embodiments, the rear fabric support member 87 has the same cross-sectional shape of the other fabric support members 86, 88, 89.

The machine carriage assembly 14 includes a machine carriage 94, a front carriage track 95, and a rear carriage track 96 as shown in FIGS. 1 and 3. The machine carriage 94 is supported on the front and rear carriage tracks 95, 96, which are affixed to the first and second end supports 80, 82.

The machine carriage 94 includes front carriage rollers (not shown) and rear carriage rollers (not shown) that provide for carriage lateral movement A, and thus for the machine lateral movement of the quilting machine 110 as shown in FIG. 3. The machine carriage 94 also includes a pair of longitudinal tracks 97, 98 that support the quilting machine 110 with an integral wheeled base (not shown) or a separate wheeled machine base to which a quilting machine 110 may be removably mounted. The longitudinal tracks 97, 98 provide for machine longitudinal movement B of the quilting machine 110 as shown in FIG. 3.

To begin sewing the quilt core 100, the quilt core 100 may be draped over the fabric support members 86, 87, 88, 89 of the frame assembly 16 and secured to the fabric support members 86, 87, 88, 89 using the retention system 18. The quilt core 100 is secured in place by coupling the retention clip 24 of the quilt core retention member 20 to the rear fabric support member 87 so that the rear fabric support member 87 is received in the support-member receiving channel 48 with the quilt core 100 draped over.

The quilt core roll 100R may be located in the quilt-core roll receiving channel 28 to move the unsewn or previously sewn fabric of the quilt core out of the way. This helps keep the fabric layers of the sewn fabric zones from interfering with the sewing of the fabric zone 120 to be positioned on the frame assembly 16 for sewing.

To locate the quilt core roll 100R in the quilt-core roll receiving channel 28, the user applies the opening force $F_O$ to the free end 32 of the elastic fabric retainer arm 26 to deflect the elastic fabric retainer arm 26 to the second loop shape as shown in FIG. 10. Once the quilt core roll 100R is located in the quilt-core roll receiving channel 28, the user releases the elastic fabric retainer arm 26 and the elastic fabric retainer arm 26 is configured to return to the first loop shape which applies the retaining force FR on the quilt core roll 100R.

With the quilt core roll 100R in the quilt-core roll receiving channel 28, the elastic fabric retainer arm 26 may have a third loop shape as shown in FIG. 11. In the third loop shape, the quilt-core roll receiving channel 28 has a third area 38A that is greater than the first area 34A but less than the second area 36A. As the fabric is unrolled to sew different sections, the elastic fabric retainer arm 26 may have a fourth loop shape as shown in FIG. 12. In the fourth loop shape, the quilt-core roll receiving channel 28 has a fourth area 40A that is greater than the first area 34A but less than the second area 36A and the third area 38A as shown in FIG. 12.

Next, the quilt core 100 is secured to the other fabric support members 86, 88, 89 with the secondary retention clips 22. Multiple secondary retention clips 22 may be used for each fabric support member 86, 88, 89 as shown in FIG. 3. The secondary retention clips 22 are coupled to the respective fabric support member 86, 88, 89 so that the respective fabric support member 86, 88, 89 is received in the support-member receiving channel 48 with the quilt core 100 draped over.

This may position a fabric zone 120 of the quilt core 100 for sewing by the quilting machine 110 as shown in FIG. 11. As shown in FIG. 11, the quilt core 100 extends out of the quilt-core roll receiving channel 28 over the rear fabric retainer arm 34, around the lip portion 46L of the retention clip 24, and wraps around the rear fabric support member 87 so that the quilt core 100 is between the rear fabric support member 87 and the clip base 42 of the retention clip 24. The quilt core 100 engages the other lip portion 44L and extends over to the front fabric support member 86, where the quilt core 100 wraps around the front fabric support member 86 so that the quilt core 100 is between the front fabric support member 86 and the retention clip 22.

Once the sewing of the fabric zone 120 is completed, the secondary retention clips 22 may be removed from each of the fabric support members 86, 88, 89. The quilt core 100 may then be moved and repositioned on the fabric support members 86, 88, 89 in a new position. By moving the quilt core 100, the quilt core roll 100R may be partially unrolled from the take-up spool 114, like as shown in FIG. 12. Alternatively, the sewn fabric may be spooled onto the take-up spool 114 by moving the quilt core 100 relative to the frame assembly 16.

The quilt core 100 may then be re-secured by coupling the secondary retention clips 22 to each of the respective fabric support members 86, 88, 89. This may position a new fabric zone 130 of the quilt core 100 for sewing by the quilting machine 110 as shown in FIG. 12.

The retention system 18 allows for flexibility in the sequence of sewing the respective fabric zones 120, 130. The retention system 18 allows the user to reposition the quilt core 100 as desired, while keeping the sewn or unsewn fabric out of the way. The quilt core retention devices 20 also allow the quilt core to easily be changed between machines if needed. As the quilt core roll 100R is located in the quilt-core roll receiving channel 28, if the quilt core 100 were to be changed to a different frame support structure 12 and frame assembly 16, the user only need remove the retention clips 24 from the rear fabric support member 87. The quilt core 100 may remain in the quilt-core roll receiving channel 28 on the fabric take-up spool 114, while the retention clips 24 are removed from the rear fabric support member 87. The retention clip 24 would keep the quilt core roll 100R in the quilt-core roll receiving channel 28 during the exchange.

While the disclosure has been illustrated and described in detail in the foregoing drawings and description, the same is to be considered as exemplary and not restrictive in character, it being understood that only illustrative embodiments thereof have been shown and described and that all changes and modifications that come within the spirit of the disclosure are desired to be protected.

What is claimed is:

1. A quilting frame unit for supporting a quilt core to be sewn by a quilting machine, comprising:

a frame support structure adapted to support a machine carriage assembly, the machine carriage assembly providing for lateral and longitudinal movement of the quilting machine;

a frame assembly affixed to the frame support structure, the frame assembly including a plurality of fabric support members configured to support the quilt core relative to the quilting machine;

at least one quilt core retention member comprising:

a retention clip configured to selectively couple to one support member of the plurality of fabric support members with the quilt core draped over the plurality of fabric support members to retain the quilt core to the one support member, and an elastic fabric retainer arm having a fixed end coupled to the retention clip and a free end spaced apart from the fixed end, the elastic fabric retainer arm shaped to define a quilt-core roll receiving channel configured to receive a quilt core roll of unsewn or previously sewn fabric of the quilt core to support the quilt core roll relative to the frame assembly when the quilt core is draped over the frame assembly, wherein the elastic fabric retainer arm is biased toward a first loop shape in which the quilt-core roll receiving channel has a first area so that the elastic fabric retainer arm applies a retaining force on the quilt core roll in the quilt-core roll receiving channel to block the quilt core roll from moving out of the quilt-core roll receiving channel, wherein the elastic fabric retainer arm is configured to deform from the first loop shape to a second loop shape in which the quilt-core roll receiving channel has a second area that is greater than the first area to accommodate a larger quilt core roll, and wherein the first loop shape and the second loop shape of the elastic fabric retainer arm each have a circular cross-section.

2. The quilting frame unit of claim 1, wherein the free end of the elastic fabric retainer arm engages the retention clip when the elastic fabric retainer arm has the first loop shape and the free end of the elastic fabric retainer arm is spaced apart from the retention clip when the elastic fabric retainer arm has the second loop shape.

3. The quilting frame unit of claim 1, wherein the retention clip comprises:

a clip base;

a first deflectable clip arm that extends from a first end of the clip base; and a second deflectable clip arm that extends from a second end spaced apart from the first end of the clip base to define a support-member receiving channel configured to receive the one support member with the quilt core draped over the one support member, wherein the fixed end of the elastic fabric retainer arm is fixed to one of the first deflectable clip arm and the second deflectable clip arm.

4. The quilting frame unit of claim 3, wherein each of the first and second deflectable clip arms comprises:

an engagement portion that defines a plurality of frame receiver facets each configured to engage with grooves on the one support member to couple the retention clip to the one support member; and a lip portion that extends from the engagement portion away from the one support member to a terminal end, wherein the lip portion of the first deflectable clip arm and the lip portion of the second deflectable clip arm define a clip throat therebetween.

5. The quilting frame unit of claim 4, wherein each of the first and second deflectable clip arms further comprises:

a tab that extends from the engagement portion away from the support-member receiving channel at a location spaced apart from the terminal end of the lip portion to define a fixed-end receiving channel therebetween, wherein the fixed end of the elastic fabric retainer arm is located in the fixed-end receiving channel to couple the elastic fabric retainer arm to the retention clip.

6. The quilting frame unit of claim 1, wherein the retention clip comprises:

a clip base; and a pair of deflectable clip arms that extend from opposing ends of the clip base to define a support-member receiving channel configured to receive the one support member with the quilt core draped over the one support member, wherein one clip arm of the pair of deflectable clip arms is formed to define a fixed-end receiving channel and the fixed end of the elastic fabric retainer arm is located in the fixed-end receiving channel to couple the elastic fabric retainer arm to the retention clip.

7. A quilt core retention device adapted to retain a quilt core to be sewn by a quilting machine to a quilting frame, the quilt core retention device comprising a retention clip configured to selectively couple to one support member of the quilting frame with the quilt core draped over the quilting frame to retain the quilt core to the one support member; and a fabric retainer arm having a fixed end coupled to the retention clip and a free end spaced apart from the fixed end, the fabric retainer arm shaped to define a quilt-core roll receiving channel configured to receive a quilt core roll of unsewn or previously sewn fabric of the quilt core, wherein the fabric retainer arm is biased toward a first loop shape in which the quilt-core roll receiving channel has a first area so that the fabric retainer arm applies a retaining force on the quilt core roll in the quilt-core roll receiving channel to block the quilt core roll from moving out of the quilt-core roll receiving channel, and wherein the fabric retainer arm has a circular cross-sectional shape.

8. The quilt core retention device of claim 7, wherein the fabric retainer arm is configured to deform from the first loop shape to a second loop shape in which the quilt-core roll receiving channel has a second area that is greater than the first area to accommodate a larger quilt core roll.

9. The quilt core retention device of claim 8, wherein the free end of the fabric retainer arm engages the retention clip when the fabric retainer arm has the first loop shape and the free end of the fabric retainer arm is spaced apart from the retention clip when the fabric retainer arm has the second loop shape.

10. The quilt core retention device of claim 7, wherein the retention clip comprises:

a clip base;

a first deflectable clip arm that extends from a first end of the clip base; and a second deflectable clip arm that extends from a second end spaced apart from the first end of the clip base to define a support-member receiving channel configured to receive the one support member with the quilt core draped over the one support member, wherein the fixed end of the fabric retainer arm is fixed to one of the first deflectable clip arm and the second deflectable clip arm.

11. The quilt core retention device of claim 10, wherein each of the first and second deflectable clip arms comprises:

an engagement portion that defines a plurality of frame receiver facets each configured to engage with grooves on the one support member to couple the retention clip to the one support member; and a lip portion that extends from the engagement portion away from the one support member to a terminal end, wherein the lip portion of the first deflectable clip arm and the lip portion of the second deflectable clip arm define a clip throat therebetween.

12. The quilt core retention device of claim 11, wherein each of the first and second deflectable clip arms further comprises:

a tab that extends from the engagement portion away from the support-member receiving channel at a location spaced apart from the terminal end of the lip portion to define a fixed-end receiving channel therebetween, wherein the fixed end of the fabric retainer arm is located in the fixed-end receiving channel to couple the fabric retainer arm to the retention clip.

13. The quilt core retention device of claim 7, wherein the retention clip comprises:

a clip base; and a pair of deflectable clip arms that extend from opposing ends of the clip base to define a support-member receiving channel configured to receive the one support member with the quilt core draped over the one support member, wherein one clip arm of the pair of deflectable clip arms is formed to define a fixed-end receiving channel and the fixed end of the fabric retainer arm is located in the fixed-end receiving channel to couple the fabric retainer arm to the retention clip.

14. A method comprising providing quilting frame unit comprising:

a frame support structure adapted to support a machine carriage assembly;

a frame assembly affixed to the frame support structure that includes a plurality of fabric support members configured to support a quilt core relative to a quilting machine on the machine carriage assembly; and at least one quilt core retention member including a retention clip and a fabric retainer arm having a fixed end coupled to the retention clip and a free end spaced apart from the fixed end, wherein the fabric retainer arm shaped to define a quilt-core roll receiving channel;

draping the quilt core over the plurality of fabric support members;

coupling the retention clip of the at least one quilt core retention member to one support member of the plurality of fabric support members with the quilt core draped over the plurality of fabric support members;

deflecting the free end of the fabric retainer arm away from the retention clip to cause the free end of the fabric retainer arm to be spaced apart from the retention clip to define a gap therebetween;

inserting the quilt core roll of unsewn or previously sewn fabric of the quilt core through the gap into the quilt-core roll receiving channel formed by the fabric retainer arm so that the quilt core roll is supported relative to the frame assembly when the quilt core roll is draped over the frame assembly;

releasing the free end of the fabric retainer arm to cause the fabric retainer arm to retain to an original shape so that the fabric retainer arm applies a retaining force on the quilt core roll in the quilt-core roll receiving channel to block the quilt core roll from moving out of the quilt-core roll receiving channel, wherein the fabric retainer arm has a circular cross-sectional shape.

15. The method of claim 14, wherein the retention clip comprises:

a clip base;

a first deflectable clip arm that extends from a first end of the clip base; and a second deflectable clip arm that extends from a second end spaced apart from the first end of the clip base to define a support-member receiving channel configured to receive the one support member with the quilt core draped over the one support member, wherein the fixed end of the fabric retainer arm is fixed to one of the first deflectable clip arm and the second deflectable clip arm.

16. The method of claim 15, wherein each of the first and second deflectable clip arms comprises:

an engagement portion that defines a plurality of frame receiver facets each configured to engage with grooves on the one support member to couple the retention clip to the one support member; and a lip portion that extends from the engagement portion away from the one support member to a terminal end, wherein the lip portion of the first deflectable clip arm and the lip portion of the second deflectable clip arm define a clip throat therebetween.

17. The method of claim 16, wherein each of the first and second deflectable clip arms further comprises:

a tab that extends from the engagement portion away from the support-member receiving channel at a location spaced apart from the terminal end of the lip portion to define a fixed-end receiving channel therebetween, wherein the fixed end of the fabric retainer arm is located in the fixed-end receiving channel to couple the fabric retainer arm to the retention clip.

* * * * *